United States Patent [19]

Fayren

[11] 4,391,332

[45] Jul. 5, 1983

[54] OFFSHORE FACILITY FOR RECOVERY HYDROCARBON DEPOSITS FROM DEEP SEA BEDS

[75] Inventor: Jose M. Fayren, Madrid, Spain

[73] Assignee: Astilleros y Talleres del Noroeste, S.A., Madrid, Spain

[21] Appl. No.: 264,951

[22] Filed: May 18, 1981

[30] Foreign Application Priority Data

May 20, 1980 [ES] Spain ..... 491.645

[51] Int. Cl.[3] ..... E21B 43/00

[52] U.S. Cl. ..... 166/350; 166/367; 405/195

[58] Field of Search ..... 405/195, 201-208, 405/224, 225; 175/5-9; 166/350, 367, 368; 114/364, 365

[56] References Cited

U.S. PATENT DOCUMENTS

| | | | |
|---|---|---|---|
| 3,324,943 | 6/1967 | Price | 166/350 X |
| 3,525,388 | 8/1970 | McClintock | 175/7 X |
| 3,999,617 | 12/1976 | Ilfrey et al. | 166/350 X |
| 4,142,584 | 3/1979 | Brewer et al. | 175/7 X |
| 4,170,266 | 10/1979 | Fayren | 405/195 X |
| 4,182,584 | 1/1980 | Panickey et al. | 405/195 |

*Primary Examiner*—Dennis L. Taylor

*Attorney, Agent, or Firm*—McGlew and Tuttle

[57] ABSTRACT

An improved facility, for the drilling and production of hydrocarbon deposits located in a deep sea bed, includes a central structural column having a bottom end secured to a submarine base mounted on the sea bed and a top end secured to a subsea buoy. A plurality of peripheral tubular conduits are located around the central structural column and connected thereto by a guide device which permits the peripheral tubular amendments to move relative thereto and positions the peripheral tubular conduits in parallel with the central structural column.

4 Claims, 1 Drawing Figure

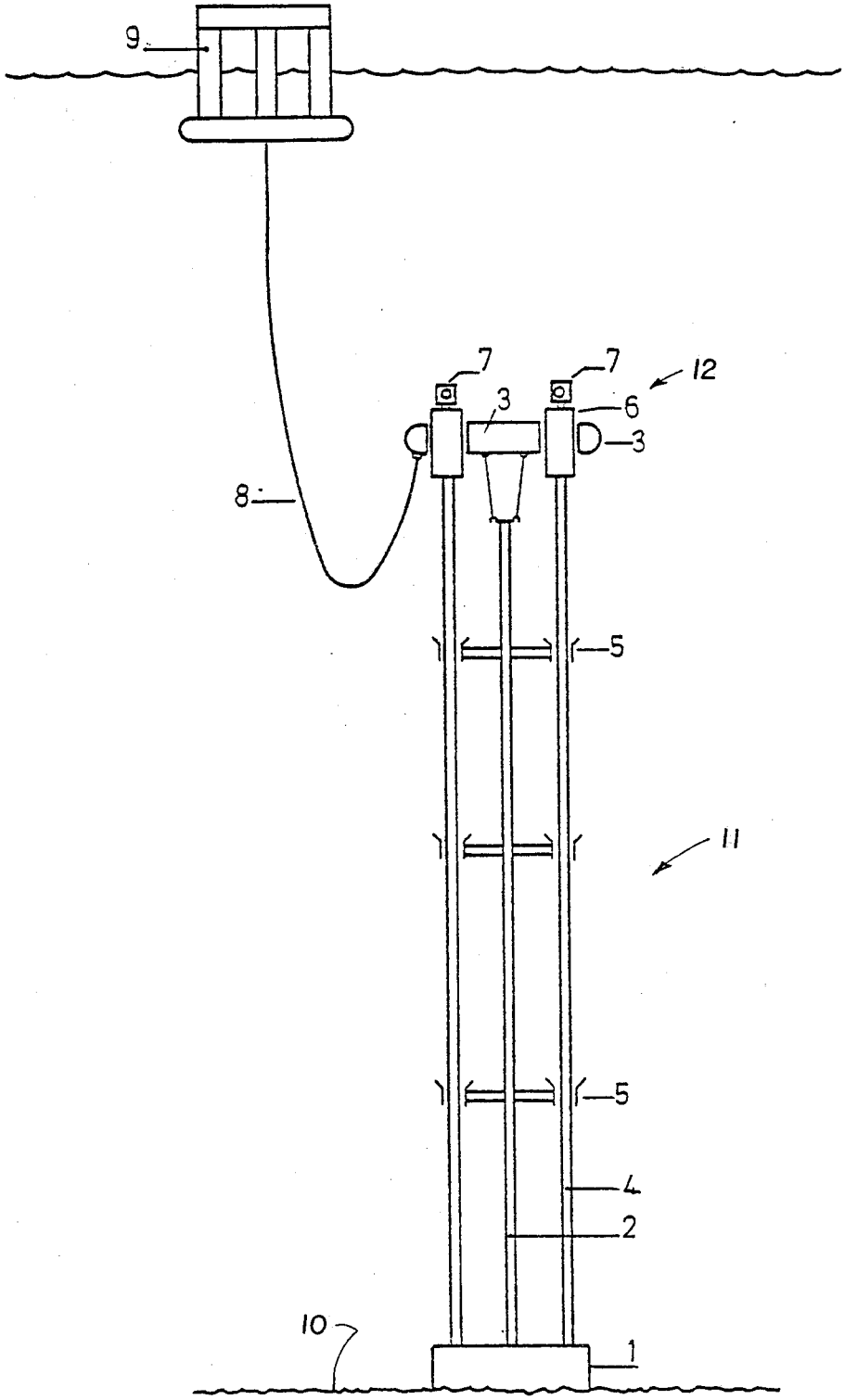
9
7
7
12
3
6
3
8
5
11
5
4
2
10
1

OFFSHORE FACILITY FOR RECOVERY HYDROCARBON DEPOSITS FROM DEEP SEA BEDS

FIELD AND BACKGROUND OF THE INVENTION

The invention relates, in general, to offshore well drilling and production directed to the recovery of hydrocarbon deposits from deep sea beds and, more particularly, to a new and useful submarine structural arrangement.

The recovery of offshore oil deposits located in very deep sea waters currently presents significant problems, among which may be mentioned the impossibility of access to the control valves that are installed on a submerged well head located on the sea bed.

In an attempt to expedite this process a facility may be composed of a submarine base having a structure secured to the sea bottom; a bundle of tubular conductors secured to said submarine base, which vertically ascends from the base to an area of moderate depth, where the effect of the surface waves is negligible; a submarine buoy secured to the top end of the tubular conductor bundle, which has a certain ascensional force that makes it possible to keep the tubular conductor bundle under vertical tension, with said submarine buoy located in the aforementioned moderate-depth area; an assembly of control devices for the drilling and later production of hydrocarbons, installed on said submarine buoy, and said devices have the function of controlling the well heads located on the top end of each tubular conductor corresponding to each of the wells; and a top conductor which ascends from the submarine buoy to the sea surface, where the floating drilling or production plant is located.

SUMMARY OF THE INVENTION

In accordance with the invention, an improved facility is provided, for the drilling and production of hydrocarbon deposits located in a deep sea bed, of the type having a submarine base secured to the deep sea bed, a bundle of tubular conduits connected to the submarine base and vertically extended therefrom to a moderate depth where the effect of sea waves is negligible, a subsea buoy connected to the top end of the bundle of tubular conduits at the moderate depth to thereby exert an ascensional force which places the tubular conduits under a vertical tension, well heads mounted on at least some of the tubular conduits, control means mounted on the subsea buoy for controlling the well heads for drilling and producing hydrocarbons, a floating plant adapted to float at sea level and a top conductor connected to the subsea buoy and the floating plant, the improvement, in combination therewith, wherein the bundle of tubular conduits comprises a central structural column having a bottom end secured to the submarine base and a top end secured to the subsea buoy, a plurality of peripheral tubular conduits located around the central structural column, guide means for securing the peripheral tubular conduits to the central structural column at vertically spaced intervals, the peripheral tubular conduits being mounted to the guide means for sliding movement relative thereto and in a parallel position relative to the central structural column.

In accordance with a preferred embodiment of the invention, the subsea buoy comprises a main buoy connected to the top end of the central structural column and peripheral buoys, each of the peripheral buoys being connected to a top end of one of the peripheral tubular conduits to support the weight of the peripheral conduits.

In accordance with another preferred embodiment of the invention, the control means comprises a plurality of control devices mounted to the top end of the peripheral tubular conduits at a submerged depth above the subsea buoy.

In accordance with still further preferred embodiment of the invention, the top conductor comprises a plurality of conductors flexibly mounted to each other in series.

Thus, it is an object of the invention, to provide an improved facility, for the drilling and production of hydrocarbon deposits located in a deep sea bed, which is simple in design, rugged in construction and economical to manufacture.

The various features of novelty which characterize the invention are pointed out with particularlity in the claims annexed to and forming a part of this disclosure. For a better understanding of the invention, its operating advantages and specific objects attained by its uses, reference is made to the accompanying drawing and descriptive matter in which preferred embodiments of the invention are illustrated.

BRIEF DESCRIPTION OF THE DRAWING

The sole FIGURE is an elevation view of a drilling and producing facility for deep sea marine oil deposits according to the invention.

DETAILED DESCRIPTION

Referring to the drawing, in particular, which illustrates a preferred embodiment of a drilling and producing facility for deep sea oil deposits, in accordance with the invention, there is shown submarine base 1 composed of a structure secured to the marine bottom 10. A tubular conductor bundle, generally indicated by reference numeral 11, ascends from the submarine base 1 to a subsea buoy, generally designated by reference numeral 12.

The tubular conductor bundle 11 is a central structural column 2 having a bottom end secured to the base 1. The column 2 supported by the tensional forces exerted by the buoyancy of the subsea buoy 3. The column 2 further comprises several peripheral tubular conduits 4 located around the central structural column 2. A series of side guides 5 is secured to the central column 2. The peripheral tubular conduits 4 pass through the inside of said side guides so that they can slide through the guides 5 while maintaining their position parallel to the central column 2.

Moreover, the structure which has been referred to up to now by the general designation of subsea buoy 12 actually is composed of an assembly of elements with their own buoyancy, namely; a main buoy 3 secured to the top end of the central structural column 2 so as to impart a tensional force on the central column 2 and an assembly of peripheral buoys 6, each secured to the top end of one of the peripheral conduits 4, for supporting the individual weight of said peripheral conduits 4, including the assembly of tubes found within them, normally used as the casing of the well and to convey the hydrocarbons produced.

The well head control devices 7 are installed on the top end of the peripheral conduits 4, on a level slightly above that of the assembly of subsea buoys 12.

A top flexible conduit 8, which ascends from the level of the subsea buoy 12 to the sea surface, consists of a flexible system of conductors, in series which join the respective well heads with a floating production plant 9, and since this system of connection is flexible, the movements that are inevitably produced in the floating plant 9 due to the action of environmental agents, are not transmitted to the submarine system composed of the tubular conductor bundle 11 topped by the assembly of subsea buoys.

Thus, in accordance with the invention, there is provided a novel arrangement for a facility, for the drilling and production of hydrocarbon deposits located in deep waters, of the type having a submarine base composed of a structure secured to the sea bottom, a bundle of tubular conductors secured to said submarine base, which rise vertically from the base to a moderate-depth area, where the effect of the surface waves is negligible, a subsea buoy, secured to the top end of the tubular conductor bundle, which exerts a certain ascensional force, allowing the aforementioned tubular conductor bundle to be kept under vertical tension, and said subsea buoy is located in the aforementioned moderate-depth area, an assembly of control devices for the drilling and later production of hydrocarbons, situated on the subsea buoy, which devices have the function of controlling the well heads located on the top end of each tubular conductor corresponding to each of the wells, and, a top conduit which ascends from the subsea buoy to the sea surface, where a floating drilling or production plant is located.

In accordance with the invention, the bundle of tubular conductors which rises from the submarine base to the subsea buoy is composed of a central structural column secured at its bottom end to the base and at its top end to the subsea buoy, with the central structural column being supported by the tensional forces exerted by the buoyancy of the subsea buoy; several peripheral tubular conductors are located around the central structural column and secured thereto by means of a series of side guides which are in turn secured to the central structural column, through the inside of said side guides pass the peripheral conductors, whereby these peripheral conductors slide within the guides while maintaining their position parallel to the central structural column.

The submarine buoy is made up of a main buoy, secured to the top end of the central structural column, which has the function of exerting a tensional force on said central structural column; and an assembly of peripheral buoys, each secured to the top end of one of the peripheral conductors, supporting the individual weight of the latter, including the assembly of tubes which are found within them, normally used for the casing of the well and to convey the hydrocarbons produced.

The control devices of the well heads are located on the top end of the peripheral conductors, on a level slightly above that of the assembly of subsea buoys.

A top conductor, which rises from the level of the subsea buoys to the sea surface, is composed of a flexible system of conductors which join the respective well heads with the floating production plant, and since this connection system is flexible, the movements that are inevitably produced in the floating plant due to the environmental agents, are not transmitted to the submarine system composed of the bundle of tubular conductors topped by the assembly of subsea buoys.

While specific embodiments of the invention have been shown and described in detail to illustrate the application of the principles of the invention, it will be understood that the invention may be embodied otherwise without departing from such principles.

What is claimed is:

1. An improved facility, for the drilling and production of hydrocarbon deposits located in a deep sea bed, of the type having a submarine base secured to the deep sea bed, a bundle of tubular conduits connected to the submarine base and vertically extended therefrom to a moderate depth where the effect of surface sea waves is negligible, a subsea buoy connected to the top end of the bundle of tubular conduits at the moderate depth to thereby exert an ascensional force which places the tubular conduits under a vertical tension, well heads mounted on at least some of the tubular conduits, control means mounted on the subsea buoy for controlling the well heads for drilling and producing hydrocarbons, a floating plant adapted to float at sea level, and a top conductor connected to the subsea buoy and the floating plant, the improvement, in combination therewith, wherein the bundle of tubular conduits comprises a central structural column having a bottom end secured to the submarine base and a top end secured to the subsea buoy, a plurality of peripheral tubular conduits located around said central structural column, guide means for securing said peripheral tubular conduits to said central structural column at vertically spaced intervals, said peripheral tubular conduits being mounted to said guide means for sliding movement relative thereto and in a parallel position relative to said central structural column.

2. An improved facility, as set forth in claim 1, wherein the subsea buoy comprises a main buoy connected to the top end of said central structural column and peripheral buoys, each of said peripheral buoys being connected to a top end of one of said peripheral tubular conduits to support the weight of said peripheral tubular conduits.

3. An improved facility, as set forth in claim 2, wherein said control means comprises devices mounted to the top end of said peripheral tubular conduits at a submerged depth above the subsea buoy.

4. An improved facility, as set forth in claim 3, wherein the top conductor comprises a plurality of conductors in catenary flexibly mounted to each other in series.

* * * * *